US008787606B2

(12) United States Patent
Gobeli et al.

(10) Patent No.: US 8,787,606 B2
(45) Date of Patent: Jul. 22, 2014

(54) ELECTRONICALLY COMPENSATED MICRO-SPEAKERS

(76) Inventors: Garth William Gobeli, Albuquerque, NM (US); Stephen Mills, Albuquerque, NM (US)

( * ) Notice: Subject to any disclaimer, the term of this patent is extended or adjusted under 35 U.S.C. 154(b) by 100 days.

(21) Appl. No.: 13/506,661

(22) Filed: May 8, 2012

(65) Prior Publication Data

US 2012/0275622 A1 Nov. 1, 2012

Related U.S. Application Data

(63) Continuation-in-part of application No. 12/423,990, filed on Apr. 15, 2009, now abandoned.

(51) Int. Cl.
*H04R 25/00* (2006.01)
*H04R 3/04* (2006.01)

(52) U.S. Cl.
CPC . *H04R 25/00* (2013.01); *H04R 3/04* (2013.01)
USPC ..... 381/321; 381/312

(58) Field of Classification Search
USPC ..... 381/97, 98, 59, 94.9, 312, 320, 321, 381/23.1, 328
See application file for complete search history.

(56) References Cited

U.S. PATENT DOCUMENTS 3,927,279 A 12/1975 Nakamura et al.
4,792,977 A 12/1988 Anderson et al.
4,887,229 A 12/1989 Weiss
4,926,139 A 5/1990 Anderson
5,425,759 A 6/1995 McDonald
5,479,522 A * 12/1995 Lindemann et al. ..... 381/23.1
5,663,727 A 9/1997 Vokac
6,553,126 B2 4/2003 Han et al.
6,804,368 B2 10/2004 Tsuda
7,184,556 B1 2/2007 Johnson et al.
2,466,829 A1 12/2008 Anderson
7,505,603 B2 3/2009 Yoo
2006/0140418 A1 6/2006 Koh et al.
2006/0188115 A1* 8/2006 Lenhardt et al. ..... 381/312
2007/0098186 A1 5/2007 Owada et al.
2007/0258598 A1 11/2007 Bai et al.

* cited by examiner

*Primary Examiner* — Tuan D Nguyen

(57) ABSTRACT

Electronics for altering the audio frequency response of a micro-speaker without modifying the micro-speaker itself are used to provide a selected frequency response of the micro-speaker. The micro-speaker has a resonant peak region, from which the response declines for both higher and lower frequencies. In one embodiment the electronics includes a first circuit for modifying the frequency response curve up to the resonant peak region, and a second circuit for modifying the frequency response curve for audio frequencies higher than this region. Each filter yields an integer multiple of 6 dB per octave slope. In the described embodiment, for approximately correcting presbyacusis (age related hearing loss), a set of high pass filters, low pass filters, and/or high order filters are connected to the micro-speaker to progressively attenuate the frequency response curve as the frequency decreases from 10000 Hz to 100 Hz.

6 Claims, 7 Drawing Sheets

ACOUSTIC FEEDBACK SUPPRESSION

ELECTRONICALLY COMPENSATED MICRO-SPEAKERS

This application is a Continuation In Part of patent application Ser. No. 12/423,990 Filed Apr. 15, 2009 now abandoned

BACKGROUND OF THE INVENTION

This invention pertains to the electronic compensation of the existing micro-speakers contained in earphones or earbud headsets. The compensation is designed to modify the normal micro-speaker output as a function of acoustic frequency so as to: (1) produce a desired response that can compensate for the hearing deficiency of users, usually elderly, that suffer from presbycusus, or age-related hearing loss, which is characterized by a hearing loss that becomes more severe as the acoustic frequency moves to higher tones. Other chosen frequency characteristics can be similarly provided.

A micro speaker is significantly different from "the generally known speaker" as shown in U.S. Pat. No. 6,553,126 by Han et. al (2003). He describes the generally known speaker in (col. 1, ln. 14-20). The "conventional micro speaker" is described in (col. 1, ln. 29-col. 2 ln. 6).
He notes, for example, that the magnet of the "known speaker" has the shape of a thick washer that is connected on both faces by the yoke and the upper plate. The vibrating element has the shape of a cone. On the other hand, for the micro speaker, the magnet is a simple disk, and the upper plate is a similar flat disk. The vibrating element is a membrane that completely covers and is suspended slightly above the upper plate. By using a vibrating element that is very thin and light, a relatively high resonance frequency response is obtained. Additionally, micro speakers are known by their quite small size, being in the range of 14 mm diameter to 9 mm diameter or slightly smaller. The smaller sizes with rare earth magnets have higher frequency resonant response peaks.

U.S. Pat. No. 7,505,603 by Yoo (2009), similarly differentiates between general speakers, combinations of speakers, and micro speakers. Again the main differences are the small size and the design layout for the micro speakers.

U.S. Pat. No. 6,804,368 by Tsuda (2004), describes a method of using a low volatile magnetic fluid as a damping mechanism for a micro speaker. He points out the differentiation between the micro speaker and conventional audio speaker.

The micro-speakers being addressed in this disclosure are those contained in earbuds/earphones used with personal audio devices such as I-Pods, MP3 players, etc. These micro-speakers usually have a diameter of 9 mm to 14 mm and their acoustic frequency characteristic is characterized by a maximum in the response that is in the range of 2000 Hz to 4000 Hz. The micro-speaker response declines for all micro-speakers at frequencies both higher and lower than the maximum by as much as 25 dB at 300 Hz and 25 dB at 10,000 Hz.

Considerable effort has been expended by various manufacturers to improve the earbud/earphone frequency-response. This work has resulted in devices that show smaller reductions in response at both high and low frequencies while at the same time moving the peak response of the micro-speaker to higher frequencies (as high as 4000 Hz.). All these efforts have concentrated on mechanical approaches. As the response curve becomes flatter the price of the earbuds increases, sometimes to several hundreds of dollars. Parenthetically, the cheap end of the earbud market is at about one dollar.

US2007/0258598 describes a method of characterizing the parameters of a micro-speaker (i.e., the frequency output characteristics). Those parameters describe the functionality of the micro-speaker itself but do not address methods of significantly changing or improving the basic micro-speaker properties. This application details how an existing earbud/earphone system's parameters (not otherwise defined) can be changed/modified by using an algorithm to select a designated parameter of the micro-speaker and optimize it by the change in other different parameters. An example is given in FIG. 5 of this application in which the sharp spikes in the frequency spectrum of a micro-speaker are suppressed by this parameter optimization method. The sharp spikes are probably due to high order mechanical coupling effects. No effort is made to modify the fundamental response spectrum of the micro-speaker.

USPAP US2006/0140418 shows a method of compensating the frequency of an acoustic system. It uses digital signal processing and it relates to the "jazz", "modern rock", etc. modes of changing the output of a portable sound system (not otherwise defined). It also discusses the possibility of modifying the "acoustic characteristics of a user" by use of a computer-audio generator-headphone system. This fitting to a specific user does not reflect the mode of modification or the intent of this disclosure.

U.S. Pat. No. 7,184,556 by Johnson et. al. (2007). Due to these significant differences noted above, one cannot justifiably apply analyses and corrective measures that are proposed for "generally known speakers" to an analysis and corrective measures for micro speakers. In Johnson, et. al. the concept of the invention is to model a speaker and its environment with a series of realizable filters and delay modules. Most of the specifications focus on defining the problems and discussing the model. Although the concept of utilizing a "conjugate" is mentioned 44 times throughout the patent, the means by which it is addressed is in the most vague and general terms, such as that it is done by a "controller" and that a "computer" can be used. In fact, Johnson really teaches nothing that is useful in actually fabricating a useable system.

US2007/0098186 describes a "tone control" for a hearing aid, sound equipment and the like. The figures in this reference are typical audio amplifier tone controls (i.e., a type of "graphic equalizer"). No mention is made, nor is there discussion of the effects of the non-uniform properties of the micro-speaker of a hearing aid or how such non-uniform response is to be corrected.

U.S. Pat. No. 3,927,279 shows a method of tailoring the electronic design of a series of amplifiers and filters to modify the output spectrum of a hearing aid. The data, shown as FIG. 6, show a maximum gain of about 25 db from 300 Hz to 1500 Hz for a control voltage of 0.9 volts. Both the spectrum and the maximum gain shown are consistent with an uncorrected micro-speaker with a battery voltage of about 1 volt. The maximum overall gain is reduced as the battery voltage is reduced due to drain on the battery that lowers the nominal voltage. No mention is made of methods for extending the amplifier output to useful values at higher frequencies (above 3000 Hz).

U.S. Pat. No. 5,475,759 speaks to the reduction of the feedback problem that causes an aggravating squeal when the gain is advanced to a very high value. A filter system is used to address the problem by utilizing two channels from an input and using one of them to provide an adaptive method to suppress the unwanted feedback component. Again, no discussion is offered concerning the response of the micro-speaker to acoustic signals of differing frequencies.

U.S. Pat. No. 4,926,139 uses a set of 4 pole filters that have a 24 db/octave filter roll off, together with an ACG circuit to tailor the resultant output to match the hearing deficiency of individual hearing aid users. This approach uses DSP components and sophisticated logic for its purpose. This patent does not address changing the spectrum of a micro-speaker.

U.S. Pat. Nos. 5,663,727, 7,466,829, 7,433,481, 4,792,977, and 4,887,229 are directed to digital hearing aids and methods used to improve the fit to individual users. None of them discuss correcting the micro-speaker response spectrum.

SUMMARY OF THE INVENTION

Current micro-speakers usually have diameters of 9 mm to 14 mm, with 10 mm being the most desirable and the one selected for use in this invention. FIG. 1., described below, shows the audio frequencies of a number of micro-speakers currently being manufactured. To facilitate comparison, all data have been normalized so that their peak intensities are positioned at the same amplitude. This invention shows that by the judicious use of filters using a combination of resistances (R) and capacitances (C) with an amplifier network, almost any micro-speaker response curve can be provided, such as one that is a continuously increasing response as the frequency increases. Any of the response curves shown in FIG. 1 can be so modified by changing the values of resistances and/or capacitances to provide a desired audio response over the frequency range from 100 Hz to at least 10,000 Hz.

One type of micro-speaker response would be that which is needed to approximate a correction for the strong decline in hearing at high frequencies that is experienced by many elderly individuals. This loss of hearing at high frequencies is denoted as presbycusis (sensorineural hearing loss). Presbycusis is widely prevalent in the elderly and is the most common type of hearing loss. A U.S. Army study conducted in 1980 indicates that 70% to 80% lose their hearing in a consistent pattern that can be predicted by age. Currently it is estimated that the hard-of-hearing population in the United States numbers about 32,000,000, with only about 20% owning needed hearing aids.

In our embodiment, the compensation characteristic is fixed and it cannot be customized for individuals. Therefore the device described herein is properly designated as a personal sound amplifier, such as iPODs and other MP3 players, since it is one-size-fits-all in concept and in design.

By judicious selection of resistance and capacitance values used in the various filter sections of this invention, it is possible to approximately correct such hearing deficiencies for the vast majority of such age-related hearing impaired individuals with a single compensation system. The truly attractive feature of such an approach is that it is "one-size-fits-all" in that a compensated earbud micro-speaker system fashioned in accordance with this invention only requires a user adjusted volume control and the user can compensate for hearing losses over a quite wide range of impairment. This fact results in a simple-to-manufacture device that offers impressive assistance to the hearing impaired at a cost that is a small fraction of the price of current hearing aids.

It should be understood that, in the disclosed embodiments, the micro-speaker itself is an off the shelf component and the frequency response curve of such micro-speaker as manufactured is not modified. The frequency response curve is changed, (e.g. made to continuously increase as the acoustic frequency increases), by altering the signal to the micro-speaker by using one or more of the filter sections of the present invention. Thus, the altered frequency response is achieved by the combination of micro-speaker and the associated filter circuits. However, as the altered signal emanates from the micro-speaker, for the purpose of describing the embodiments of this invention the response of the system is generally referred to as the response of the micro-speaker (e.g., changing the audio frequency response curve of the micro-speaker).

It is the object of this invention to provide a simple and direct means for changing/modifying the output audio spectrum of a variety of micro-speakers that are currently manufactured by a plethora of entities.

It is a further object of this invention to provide a methodology based on the design of multiple electronic filters for changing the basic output spectrum of micro-speakers.

It is a further objective of this invention to provide a straightforward method of correcting the typical micro-speaker response by the careful and judicious use of a set of high-pass, low-pass filters, and high order filters.

BRIEF DESCRIPTION OF THE DRAWINGS

The invention will become readily apparent from the following detailed description that refers to the accompanying drawings.

DETAILED DESCRIPTION OF THE INVENTION

The definition of a micro speaker is related to both its size and its basic construction. The size is from 14 mm diameter to 9 mm diameter and smaller. Its construction puts the magnet into the shape of a slab, rather than a hollow cylinder of the "generally known speakers". The vibrating element is a very thin membrane suspended above the magnet center rather than being cone shaped as in "generally known speakers"

Figure 1:
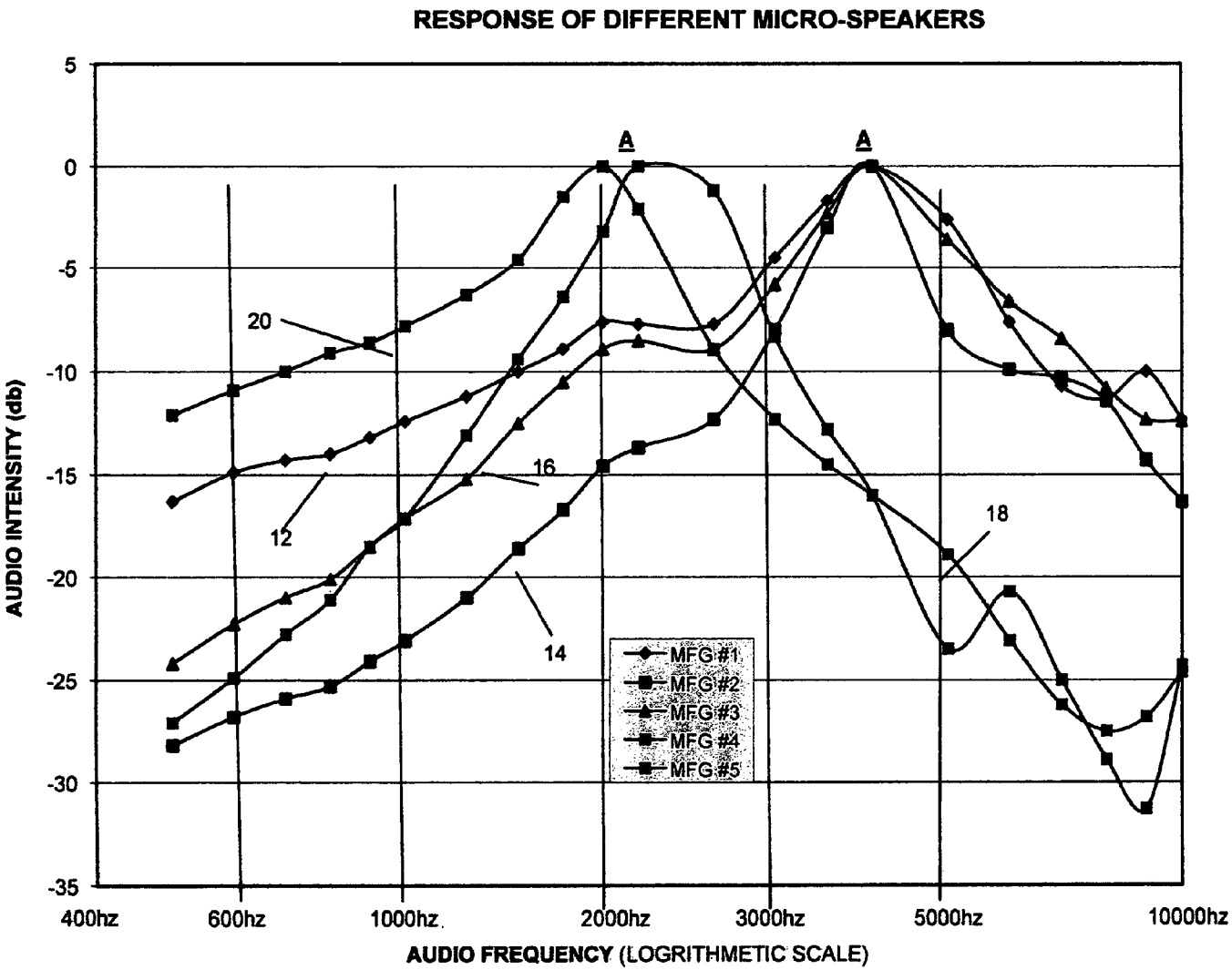
FIG. 1A graph of Log Audio Intensity (dB) vs. Log Audio Frequency for 5 manufacturer's earbud micro-speakers, wherein the resonant peak region for all such speakers is normalized to 0 dB.

The experimentally measured output acoustic spectra of some commercially available earbud micro-speakers are illustrated in FIG. 1 for five different manufacturers (12, 14, 16, 18, and 20). Note that each speaker has a resonant peak region (A) in the audio intensity as a function of audio frequency. The location of each resonant peak region lies between 2000 Hz and 4000 Hz, with the smaller diameter earbud micro-speakers that have rare-earth magnets being at the higher frequencies. In all cases shown in FIG. 1, the response declines for frequencies both higher and lower than the resonant peak region. This type of response as a function of frequency is due to the resonant vibration modes of the diaphragm of the micro-speaker. The responses of some micro-speakers have been improved by careful mechanical design, reducing the thickness of the speaker diaphragm, and careful attention to the characteristics of the grill covering of the speaker.

Compensation of Micro-Speakers for High Frequency-Enhanced Performance

Figure 2:
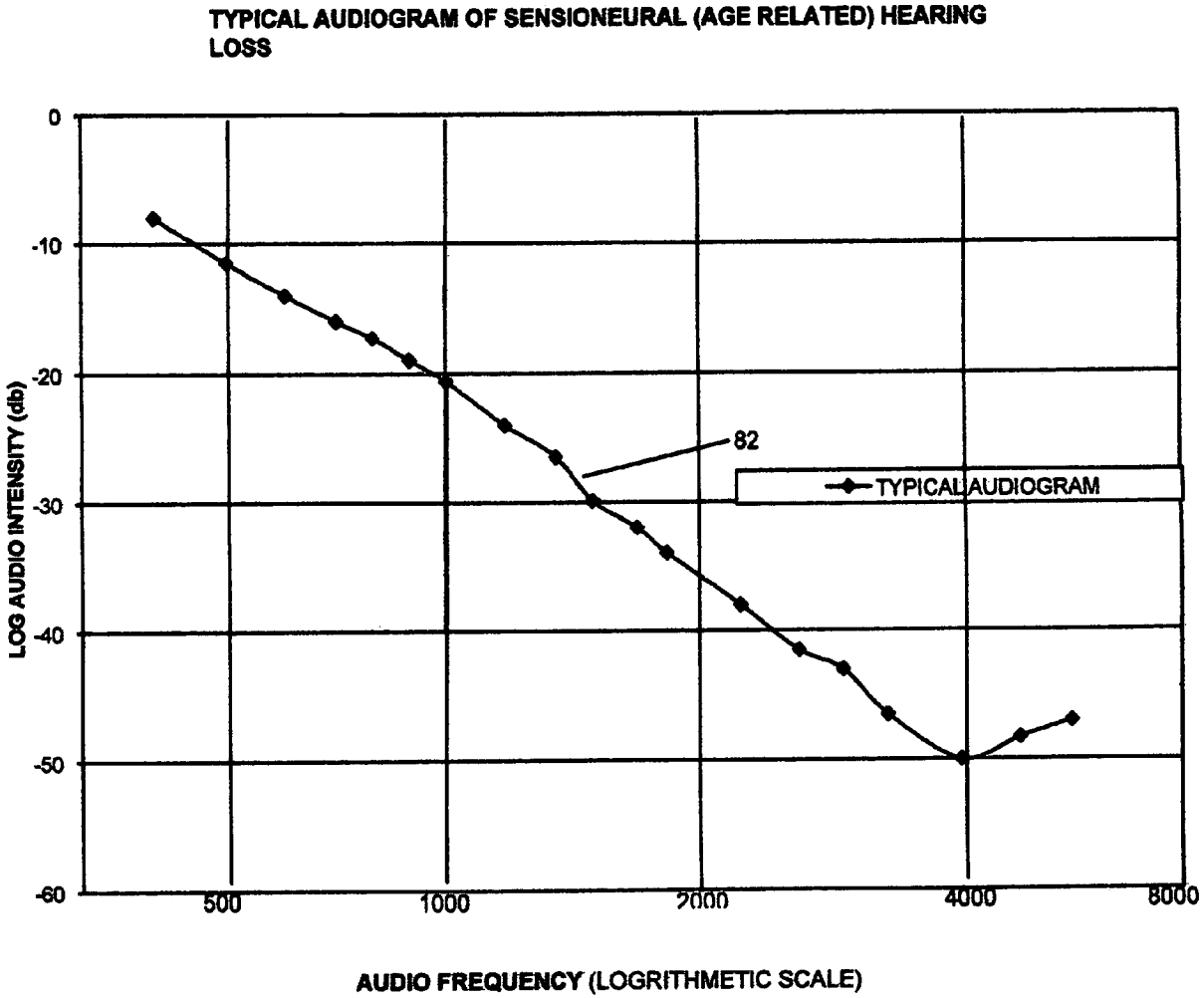
FIG. 2 A typical audiogram of a person with moderate to deep presbycusis (sensioneural or age-related hearing loss).

Another excellent use for a compensated micro-speaker is to filter the basic micro-speaker response vs. audio frequency to provide a continuously higher output as the frequency increases. Such a system would then provide appropriate compensation to the common sensorineural (age-related) hearing loss of the elderly. This type of high-frequency hearing loss is alternately called presbycusis and is synonymous with the aging process. This hearing loss is illustrated in FIG. 2, curve 82 which shows a typical hearing audiogram for a moderate to significant presbycusis hearing impairment. This audiogram is plotted as LOG of the Audio Intensity (conventionally shown as decibels, dB), as a function of the LOG of the audio frequency. The curve for a very large percentage of the hearing impaired population is characterized by the linear nature of the hearing loss in terms of loss in dB per octave frequency change. This plot of an individual's hearing loss is named an audiogram. It is estimated that 70% to 80% of hearing loss in the elderly is represented by an audiogram that is similar to that shown in FIG. 2. The difference between individuals lies in the magnitude of the loss and is characterized by approximately by a straight line on this type of diagram (an audiogram). The steeper the line the greater is the hearing loss. The severity of a person's hearing loss is sometimes described by the lowest point on the audiogram. The loss at a frequency, for example at 6000 Hz, can be 40 dB for mild hearing loss to 80 dB for profound hearing loss. The indicated loss shown by curve 82 is about 50 dB. The "hook" or "dip" at the high frequency end of the audiogram suggests that part of this individual's hearing loss is due to some type of damage to the ear, such as a loud noise environment, shooting, etc.

Figure 3:
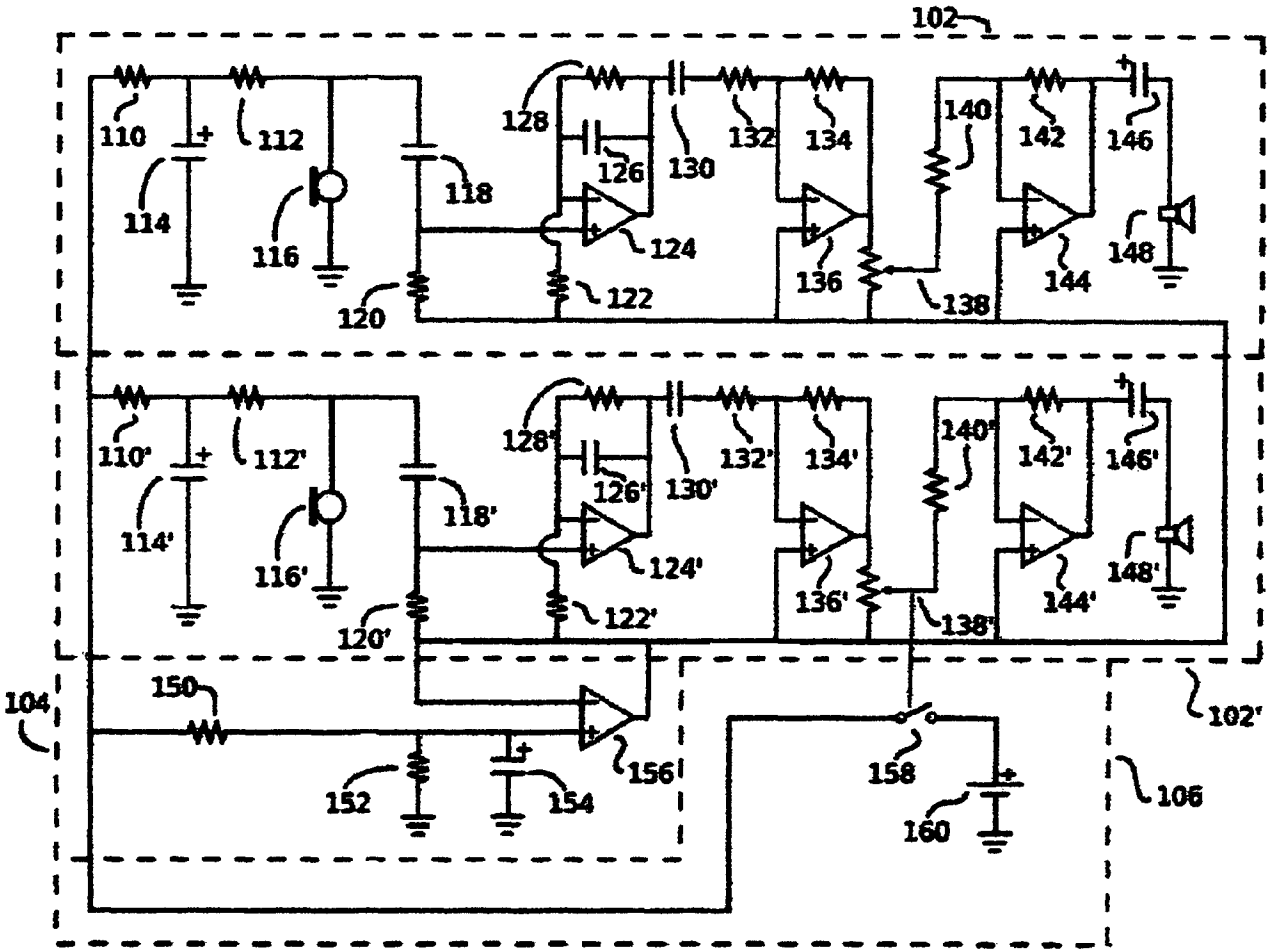
FIG. 3 A diagram of circuits of the embodiment of the present invention, used to provide micro-speaker compensation to correct hearing loss shown in FIG. 2.

The solution to this hearing loss problem then is to provide a set of amplifiers-filters for both ears that will restore the person's hearing spectrum to approximately a flat response. The specific type of micro-speaker for efficiently making this correction is selected from FIG. 1, and the best choice is 12. This is due to the overall small decline in audio intensity from the peak at 4000 Hz to both 400 Hz and 8000 Hz. Examination of this curve shows that the low frequency decline is between −3 dB/octave and −4 dB/octave and the high frequency decline is about −6 dB/octave. The correcting amplifiers/filters are shown in FIG. 3.

The personal sound amplifier circuit (100) is comprised of several sections: a power source (106), a bias circuit (104), and right and left channels (102, 102'). The left channel (102') is a duplication of the right channel (102), and descriptions given of the operation of the right channel (102) will pertain to the left channel (102') as well.

In the power source section (106), a rechargeable Lithium-Ion battery (160) supplies power at a nominal 3.7 volts to the rest of the circuitry through a switch (158).

In the bias circuit section (104), two resistors (150, 152) of equal value constitute a voltage divider, which yields a voltage at one-half of the battery voltage. A capacitor (154) filters the resultant voltage so as to minimize systemic noise and obviate any possible systemic feedback via the power source buss. The filtered voltage is presented to the non-inverting input of an operational amplifier (156) which is configured for unity gain. The output of the operational amplifier (156) thereby presents a buffered low impedance bias voltage to circuitry in the right and left channels (102, 102'). The bias voltage causes the amplification circuitry within the right and left channels (102, 102') to operate proximal to a voltage centered at one-half of the battery voltage, thereby allowing voltage excursions consequent to the normal action of signal amplification to be maximized without clipping.

In the right channel section (102), the power source voltage is conditioned by a filter circuit, comprised of a resistor, (110) and capacitor (114) so as to minimize systemic noise and obviate any possible systemic feedback via the power source buss. The conditioned voltage is presented to an electret microphone module (116) via a bias resistor (112). Acoustical pressure incident to the microphone module (116) causes it to develop a signal current which flows through the bias resistor (112) causing a signal voltage to develop across the resistor. The signal voltage is coupled to the non-inverting input of an operational amplifier (124) in an amplification stage (120, 122, 124, 126, 128) via a capacitor (118). The capacitor (118) and resistor (120), which are connected to the operational amplifier (124) non-inverting input, constitute a high-pass filter and are sized to pass only signals at or above the lowest frequency of interest, which in this case is about 50 Hz. The capacitor (126) and resistor (128), which are connected between the output and the inverting input of the operational amplifier (124), constitute a low-pass filter and are sized to pass only signals at or below the highest frequency of interest, which in this case is about 16 kHz. The pass-band gain of the amplification stage is set by the approximate ratio of two resistors (122, 128), which in this case is about 100. The amplified signal is coupled to the inverting input of an operational amplifier (136) in the next amplification stage (132, 134, 136) via a capacitor (130). The capacitor (130) and resistor (132) which are connected to the operational amplifier (136) inverting input constitute a high-pass filter and are sized to progressively attenuate, at a slope of 6 dB per octave, signals below a chosen inflection point set at a high frequency, which in this case is about 10 kHz. The pass-band gain of the amplification stage is set by the approximate ratio of two resistors (132, 134), which in this case is about 100. The amplified signal is passed to the inverting input of a high current output operational amplifier (144) in the final amplification stage (140, 142, 144) via a variable resistor (138) which serves as a volume control. The pass-band gain of the amplification stage is set by the approximate ratio of two resistors (140, 142), which in this case is about 10 when the rotational shaft of the variable resistor (138) is positioned to its fully clockwise setting. The final amplified signal is coupled to the micro-speaker (148) via a capacitor (146). The capacitor (146) together with the electrical impedance of the micro-speaker (148) constitute a high-pass filter and are sized to pass only signals at or above the lowest frequency of interest, which in this case is about 50 Hz.

In this embodiment of the invention, surface mount components are used for all capacitors, fixed value resistors, and operational amplifiers. Polarized capacitors (114, 146, 154) are tantalum; non-polarized capacitors (118, 126, 130) are NP0 ceramic. At the bias circuit, input amplification stage, and middle amplification stage, the operational amplifiers (124, 136, 156) are low noise, low power supply voltage types such as National Semiconductor LMP7732. The output operational amplifier (144) has high current and rail-to-rail output drive capabilities such as ST Electronics TS482. Electret microphone modules (116) are low noise types with a built-in field effect transistor buffer/amplifier such as Panasonic WM61A.

Figure 4:
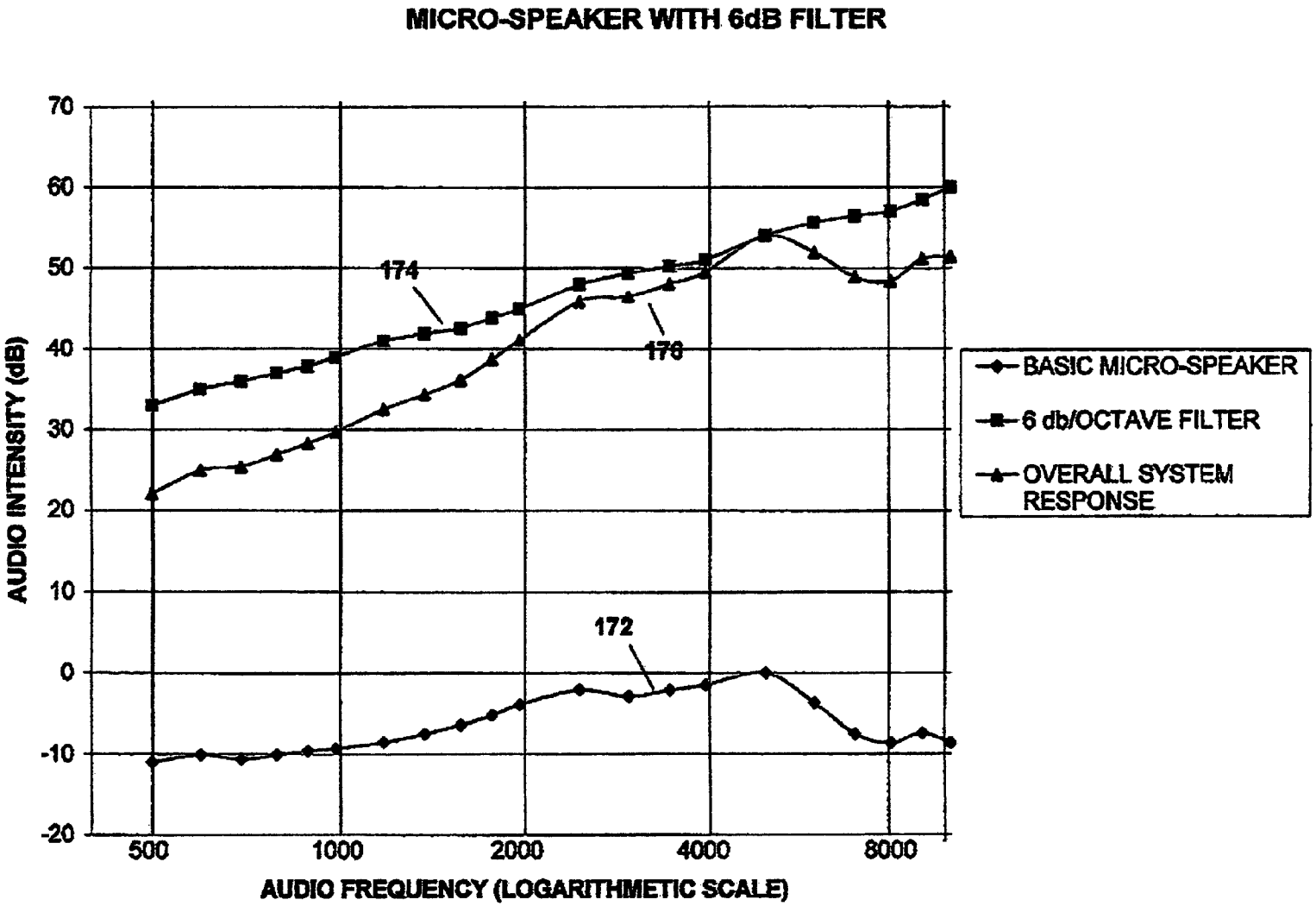
FIG. 4 A chart showing basic micro-speaker response, the 6 dB/octave high pass filter, and the resultant micro-speaker filtered response.

FIG. 4 shows the effect on the basic measured micro-speaker response (curve 172) by adding the modified response obtained with the amplifier/filter set of FIG. 3 (i.e., curve 174). The resultant final compensated output of the filtered micro-speaker is then curve 176. Note that the magnitude of the signal at 10,000 Hz requires an overall gain of 60 dB or more at 10,000 Hz. With the rechargeable Lithium-Ion battery (that has a nominal output of 3.7 volts) the achievable gain is about 90 dB, but feedback problems currently limit the useable gain to about 80 dB.

Figure 5:
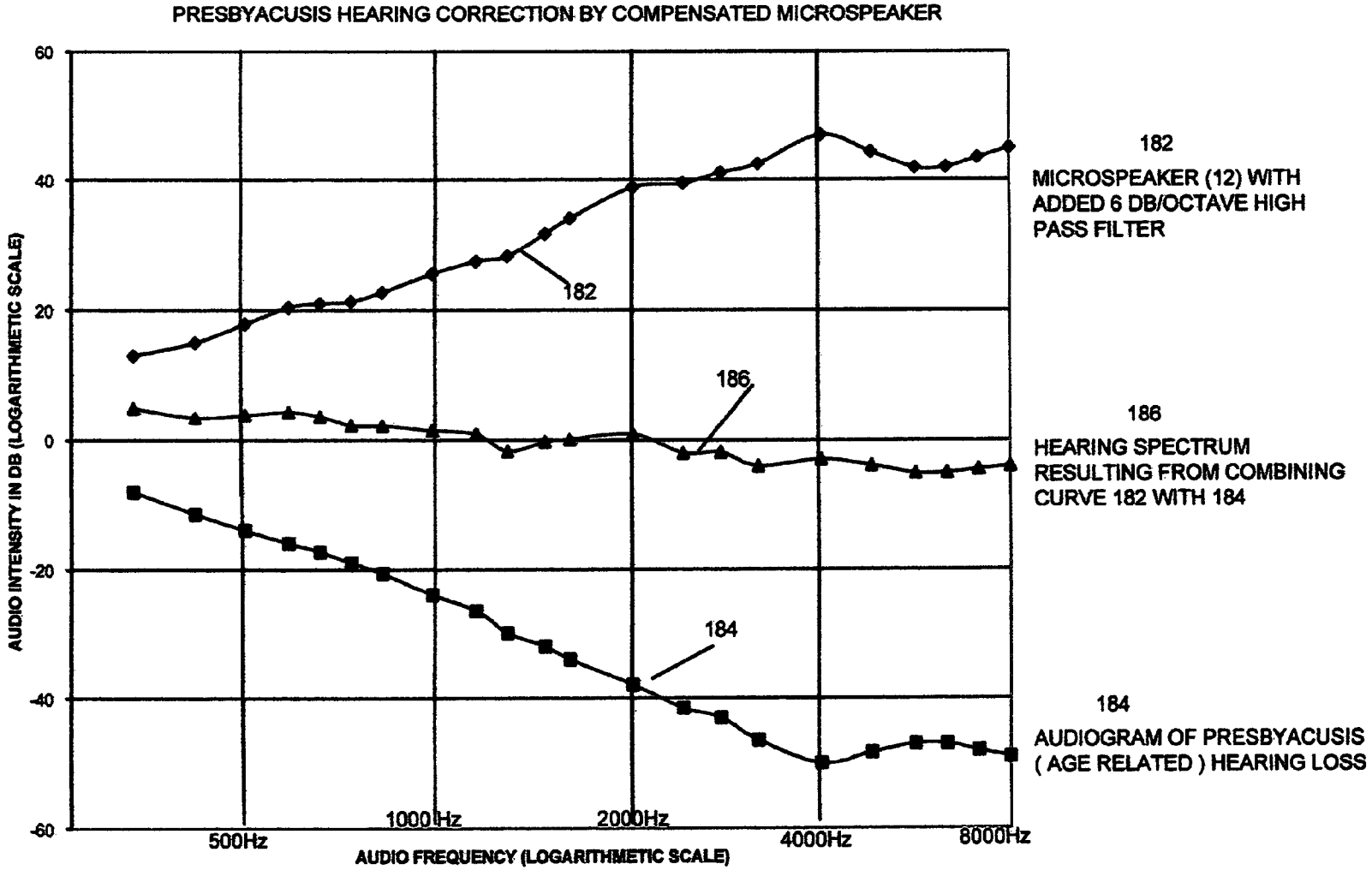
FIG. 5 A chart showing the resultant micro-speaker response of FIG. 4, the audiogram of FIG. 2, and the resultant users hearing response curve.

FIG. 5 shows the effect of adding the compensated micro-speaker response curve 182 (curve 176 from FIG. 6) to the typical audiogram 184 (curve 82 from FIG. 4). Curve 186 shows the resultant perceptive hearing of the individual from whom the audiogram was taken. Note that the slope of the compensated frequency response curve approximates the mirror image of the audiogram, such that the perceptive hearing of the individual from whom the audiogram was taken is well within the range of normal hearing (plus or minus 10 dB) and, in the illustrated embodiment, essentially flat. Note also that the vertical scale of this figure is much different from the earlier figures (e.g., FIG. 4). Thus, for instance, while curve 182 appears stretched vis-à-vis curve 176, the two are in fact the same.

The striking feature of this curve 186 is that the hearing level for this audiogram has been corrected to plus-or-minus 5 dB over the entire hearing frequency range of 400 Hz to 10,000 Hz. (The accepted range of normal hearing is specified as plus-or-minus 10 dB.) It has been found that the additional voltage offered by using 3.7 volt. Lithium Ion batteries versus the 1.1 volt ZnO standard hearing aid batteries permits the amplification of the heavily filtered system to be sufficient to restore hearing for frequencies above 4000 Hz. It is not possible to provide this high frequency hearing for such a heavily filtered system when 1.1 volt batteries are used. Current hearing aid designs simply do not provide this magnitude of gain. They are currently limited to not more than 29 to 32 db, usually at the peak frequency of the micro-speaker/transducer that is used. The gain at frequencies above 4000 Hz is minimal for hearing at these frequencies relative to the peak response near 3500 Hz.

The use of a compensation system that uses the circuit illustrated in FIG. 5 can be effective for a very large range of such hearing impaired individuals. That is, whether the maximum hearing loss shown in an audiogram is 40 db or 70 db, the same compensated micro-speaker system has been shown to provide an extremely satisfactory hearing experience so long as the gain can be adjusted for best results by the user. This one-size-fits-all methodology gives major assistance to most of the population for which a hearing aid is needed. This factor, together with the modest price at which the compensated micro-speaker system can be produced, makes this invention very useful and unique.

Figure 6:
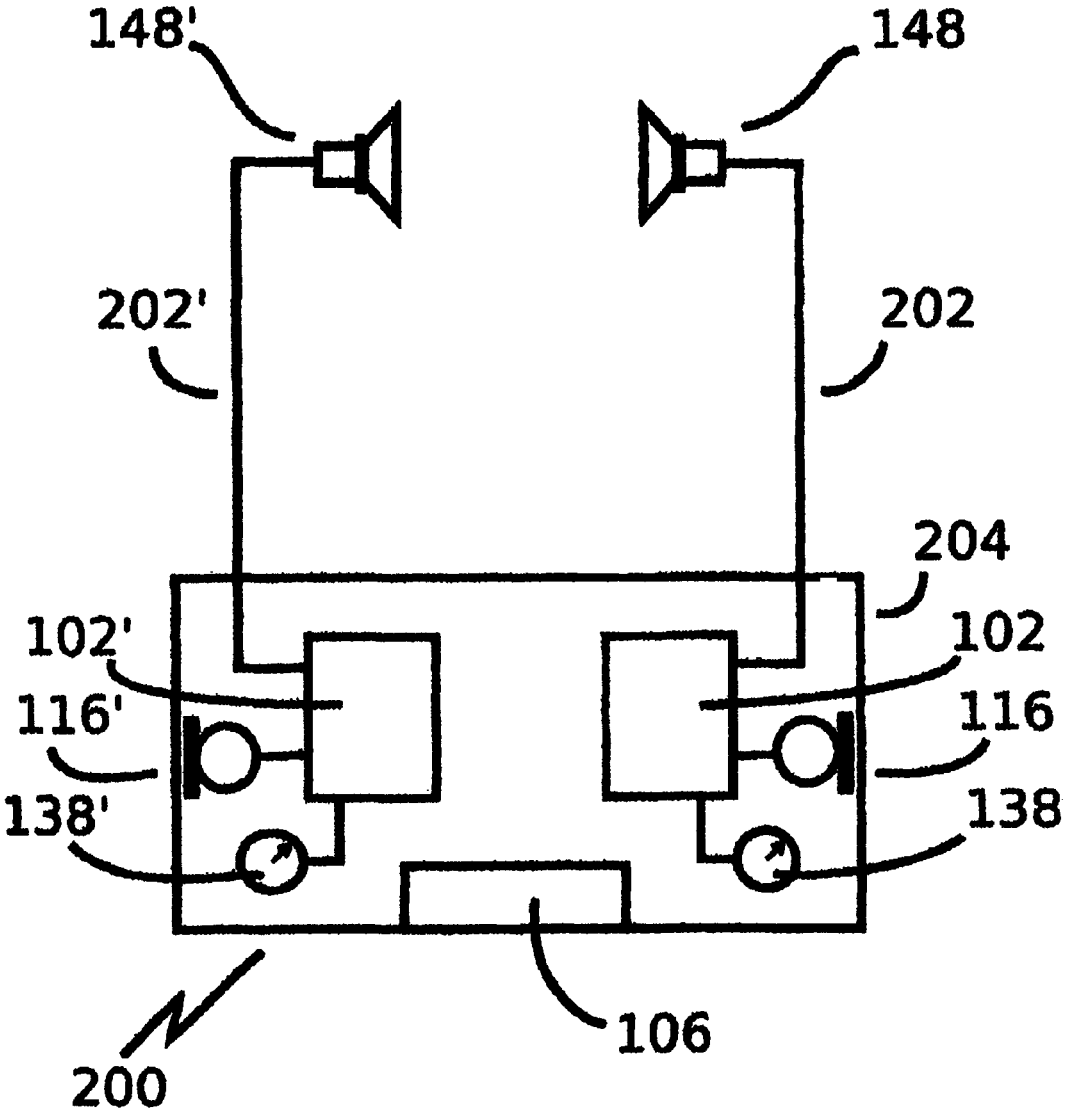
FIG. 6 A schematic layout of a hearing instrument that uses two circuits of FIG. 3.

FIG. 6 shows a package layout (200) that can be used for either the "flat" or the "sensorineural-compensation" assembly. The electronics for the two ears (102, 102') are contained in a common case (204) which can be of plastic or metal This case is expected to have dimensions of about 2.5 inches×1.75 inches×0.75 inches although larger or smaller cases might be used. Right and left microphones (116, 116') are mounted on the right and left sides respectively of the case. Right and left volume controls (138, 138') one of which has an off-on switch, are used by the individual to adjust the two gains. A separate slide switch for off-on power control may be used instead. The volume controls serve two purposes: (1) to compensate for the attenuation in signal caused by the filters in the right and left channels (102, 102'); and (2) to allow the user to select the gain appropriate for the hearing loss for each of his/her ears. The resultant output signals are routed to the right and left earbud micro-speakers (148, 149') via connection flexible cables (202, 202') that are part of the earbud set. A rechargeable Lithium-Ion battery (106) That operates at a nominal voltage of 3.7 volts is used to provide power for the electronics and the micro-speaker and driver integrated circuit.

The case can be worn in a shirt pocket or suspended around the neck from a lanyard when the device is used as a hearing aid. It is found that wearing the hearing aid embodiment of the device beneath light-weight outer clothing has a negligible effect on the performance, so the device can be worn concealed.

For use by hearing impaired individuals to hear a flat response from I-Pods and/or MP3 players it only will be necessary to modify the input parameters of the standard presbycusis (sensineural-hearing-loss) design and then use the standard I-Pod output to drive the system. This change has been accomplished by adding a second input jack to the system that provides any electronic changes in input parameters that are required.

Acoustical Feedback Suppression

Acoustical feedback can be reduced using notch filters. For a given product line, a tendency to feedback at specific frequencies can be characterized empirically. A notch filter can be placed at the most prominent feedback frequency. It will be seen, however, that feedback may still occur, but it is now shifted to a new frequency. If a second notch filter is placed at this new frequency, a third feedback frequency might appear, and so on. There is an advantage, however, in that each newly shifted feedback frequency tends to occur with the amplifier set at a slightly higher gain. Therefore, a plurality of such notch filters, each set at its own empirically determined frequency for the given product line, can allow a higher useable amplifier gain setting, thereby extending the amplification capability of the hearing assist device.

The notch filters in this invention are adaptive; they are employed only when acoustical feedback is detected so as to not needlessly interfere with the ability to hear desired audio at the filter frequencies.

Figure 7:
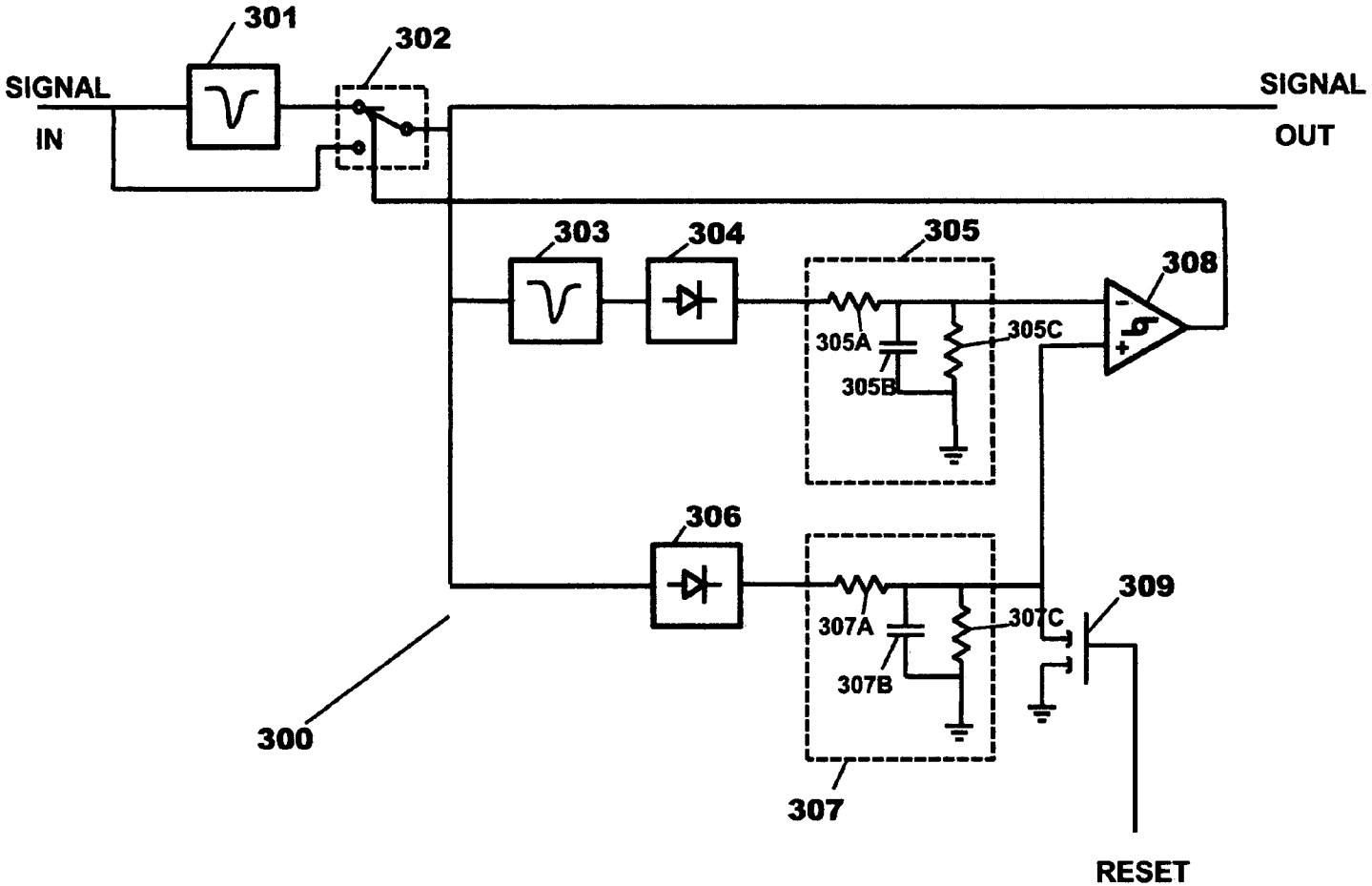
FIG. 7 Acoustical Feedback Suppession

An embodiment of a single notch filter section is shown in FIG. 7. The signal is either passed through or bypasses the notch filter [301] as determined by the position of an analog switch [302]. To determine whether the analog switch should select the notch-filtered signal, a test for feedback occurring at the notch filter frequency is made. Two signal branches are employed, each processing the signal differently. The presence of an acoustical-feedback event that is occurring at the notch filter frequency of this filter section can be detected by a comparator [308].

A reference-voltage, proportional to the amplitude of the desired audio, being passed through the circuit is generated by the upper signal branch of FIG. 7. The signal is first processed a notch filter [303] identical to the previously discussed notch filter [301]. The signal is converted to DC by a rectifier circuit [304], and is then filtered by a resistor-capacitor network [305]. The capacitor [305B] is charged through a resistor [305A], which is chosen to produce a relatively fast time constant such that the amplitude of the audio is rapidly determined, e.g. on the order of 20 mS. The capacitor [305B] is discharged through resistor [305C], which is chosen to produce a relatively slow time constant such that diminishing audio is slowly detected, e.g. on the order of 2000 mS.

Thus, a DC signal is presented to the inverting input of the comparator [308]. Because the second notch filter [303] is present, the DC voltage represents an audio amplitude independent of any feedback event occurring at the notch filter frequency, and in this sense is considered a reference voltage to which the signal presented to the non-inverting input of the comparator [308] is compared.

A feedback-detection voltage that is proportional to the amplitude of the desired audio plus possible feedback-frequency is passed through the circuit, is generated by the lower signal branch of FIG. 7. No notch filter is employed in this branch. The signal is converted to DC by a rectifier circuit [306], and is then filtered by a resistor-capacitor network [307]. The capacitor [307B] is charged through a resistor [307A], which is chosen to produce a relatively fast time constant such that the amplitude of the audio is rapidly determined, e.g. on the order of 20 mS. The capacitor [307B] is discharged through resistor [307C], which is chosen to produce a relatively slow time constant such that diminishing audio is slowly detected, e.g. on the order of 2000 mS. Thus, a DC signal is presented to the non-inverting input of the comparator [308]. Because no notch filter is present, the DC voltage represents an audio amplitude which includes any feedback event occurring at the notch filter frequency, and in this sense is considered a feedback detection voltage which is compared to the signal presented to the inverting input of the comparator [308].

An acoustical feedback event, occurring at the frequency for which the notch filters of this circuit section are tuned, produces a high amplitude signal which causes a feedback detection voltage to appear at the non-inverting input of the comparator [308] which is higher than the reference voltage which appears at the inverting input of the comparator [308]. The comparator [308] is thereby turned on, and its output voltage in turn activates the analog switch [302], thus inserting the desired notch filter [301] into the circuit to quell the feedback occurring within its notch bandwidth.

The comparator [308] is configured with a small amount of hysteresis so as to avoid a series of rapid switch actions back and forth in situations where the voltages at the inverting and non-inverting inputs are nearly equal. In the condition of nearly equal input voltages, the hysteresis will cause the comparator [308] to retain its previous state, despite any minor voltage fluctuations.

If the circuit has detected an acoustical feedback event and switched in the notch filter [301], the acoustical feedback might be quelled, leading to a subsequent uncertainty as to whether the external acoustical feedback condition still remains. To determine whether the notch filter can be switched out of the circuit path, a test can be performed by resetting the circuit periodically, e.g. once per second. The periodic reset signal is presented to the gate of a MOSFET [309] which, in turn, discharges the capacitor [307B] in the feedback detection branch, forcing the circuit into a non-detection state. If the external acoustical feedback condition still remains, the circuit will detect a short pulse of recurring feedback and promptly switch the notch filter [301] back in. If the external acoustical feedback condition is no longer present, the circuit will remain in its normal state without the notch filter [301] switched into the circuit path.

The reset device is shown in FIG. 7 as a MOSFET [309], but this function could be accomplished equally well by a base junction transistor or by an analog switch. The reset signal could originate from a micro-controller, an oscillator, or any similar source.

For greatest effectiveness, a plurality such circuits shown in FIG. 7 are typically utilized, the notch filters of each section being tuned to a different frequency of concern in suppressing acoustical feedback. The circuits can simply be chained in series, and can share a common reset line.

Whereas the drawings and accompanying description have shown and described the preferred embodiment of the present invention, it should be apparent to those skilled in the art that various changes may be made in the form of the invention without affecting the scope thereof.

We claim as follows:

1. An apparatus for correcting presbycusis hearing loss comprising: (a) two micro-speakers small enough to fit into the ear canals of a user; (b) connecting the micro-speakers to electronic circuits; (c) tailoring the electronic circuits to compensate for the presbycusis hearing loss; (d) providing microphones capable of receiving sound in the range of 10 Hz to 8000 Hz; (e) providing a power source of sufficient capacity and voltage to enable the device to function for at least 48 hours and to be of sufficiently small size as to fit into a pocket of the user; (f) providing a power source of a rechargeable battery of at least 3 volts; (g) such that the user will be able to hear all frequencies in the range of 10 Hz to 8000 Hz; (h) one of two micro-speakers having a resonant peak region that generally increases in slope (representing an increase in decibels) as the audio frequency increases up to the resonant peak region; (i) the one of two micro-speakers further having a frequency response curve that generally decreases in slope (representing a decrease in decibels) as the audio frequency increases beyond the resonant peak region; (j) a circuit to modify the one of two micro-speakers including a first circuit for modifying the frequency response curve up to the resonant peak region; and (k) a circuit to modify the one of two micro-speakers also including a second circuit for modifying the frequency response curve for audio frequencies higher than the resonant peak region.

2. An apparatus for correcting presbycusis hearing loss as set forth in claim 1, wherein the first circuit includes one or more of the group consisting of: a high pass filter, a low pass filter, and a high order filter.

3. An apparatus for correcting presbycusis hearing loss as set forth in claim 1, wherein a first filter yields an integer multiple of 6 dB per octave slope.

4. An apparatus for correcting presbycusis hearing loss as set forth in claim 1, wherein a second filter has first and second transition regions defining the range of frequencies over which the audio frequency response curve is modified.

5. An apparatus for correcting presbycusis hearing loss as set forth in claim 1 further comprising:

(a) a low pass filter for modifying the slope of the frequency response curve at frequencies up to the resonant peak region, the low pass filter including a first transition region where the attenuation changes from 0 dB per octave to an integer multiple of 6 dB per octave and a second transition region where the attenuation changes from an integer multiple of 6 dB per octave to 0 dB per octave;

(b) setting a first transition region at a frequency below the resonant peak area; and (c) setting a second transition region at a frequency in the resonant peak region.

6. An apparatus for correcting presbycusis hearing loss as set forth in claim 1, further comprising:

(a) a high pass filter for attenuating the slope of the frequency response curve at frequencies above the resonant peak region, the high pass filter including a first transition region where the attenuation changes from 0 dB per octave to an integer multiple of 6 dB per octave to a second transition region where the attenuation changes from an integer multiple of 6 dB per octave to 0 dB per octave;

(b) setting a first transition region of the high pass filter at a frequency in the resonant peak region; and (c) setting a second transition region of the high pass filter at a frequency above the resonant peak region; and thus modifying the frequency response curve between the peak resonant region and the frequency set for the second transition region of the high pass filter.

* * * * *